US005093939A

United States Patent [19]

Noyerie et al.

[11] Patent Number: 5,093,939

[45] Date of Patent: Mar. 10, 1992

[54] MOTORCYCLE HELMET

[75] Inventors: Jean P. Noyerie; Gilles Basson, both of Chatillon S/Chalaronne, France

[73] Assignee: Gallet S. A., Chatillon S/Chalaronne, France

[21] Appl. No.: 626,708

[22] Filed: Dec. 12, 1990

[30] Foreign Application Priority Data

Dec. 14, 1989 [FR] France ..... 89 16855

[51] Int. Cl.[5] ..... A42B 1/08

[52] U.S. Cl. ..... 2/424; 2/425

[58] Field of Search ..... 2/410, 421, 424, 425

[56] References Cited

U.S. PATENT DOCUMENTS

| | | | |
|---|---|---|---|
| 4,290,150 | 9/1981 | Guerre-Berthelot | 2/421 |
| 4,532,658 | 8/1985 | Zago | 2/421 |
| 4,573,222 | 3/1986 | Zago | 2/424 |
| 4,598,430 | 7/1986 | Nava | 2/410 |
| 4,641,382 | 2/1987 | Gessalin | 2/421 |
| 4,766,615 | 8/1988 | Morin et al. | 2/421 |
| 4,769,857 | 9/1988 | Cianfanelli et al. | 2/424 |

FOREIGN PATENT DOCUMENTS

| | | | |
|---|---|---|---|
| 72767 | 2/1983 | European Pat. Off. | 2/410 |
| 134183 | 3/1985 | European Pat. Off. | 2/410 |
| 2720785 | 11/1978 | Fed. Rep. of Germany | 2/421 |
| 3143796 | 5/1983 | Fed. Rep. of Germany | 2/410 |
| 3628739 | 2/1988 | Fed. Rep. of Germany . | |
| 2119229 | 11/1983 | United Kingdom | 2/421 |

*Primary Examiner*—Werner H. Schroeder
*Assistant Examiner*—Michael A. Neas
*Attorney, Agent, or Firm*—Herbert Dubno; Andrew Wilford

[57] ABSTRACT

A helmet has a rigid head piece adapted to fit over a wearer's head and having a forwardly open cutout aligned with the wearer's face and a chin guard formed by a pair of generally identical right and left arms. Each arm is rigid and has a rear end juxtaposed with the respective side of the head piece and a front end. Mechanisms engaged between each rear end and the respective head-piece side can move the arms between a closed position with their front ends meeting underneath the face cutout and an open position with their front ends spaced apart and flanking the cutout. Latches on the front ends of the arms lock them together in the closed position.

20 Claims, 5 Drawing Sheets

FIG_11
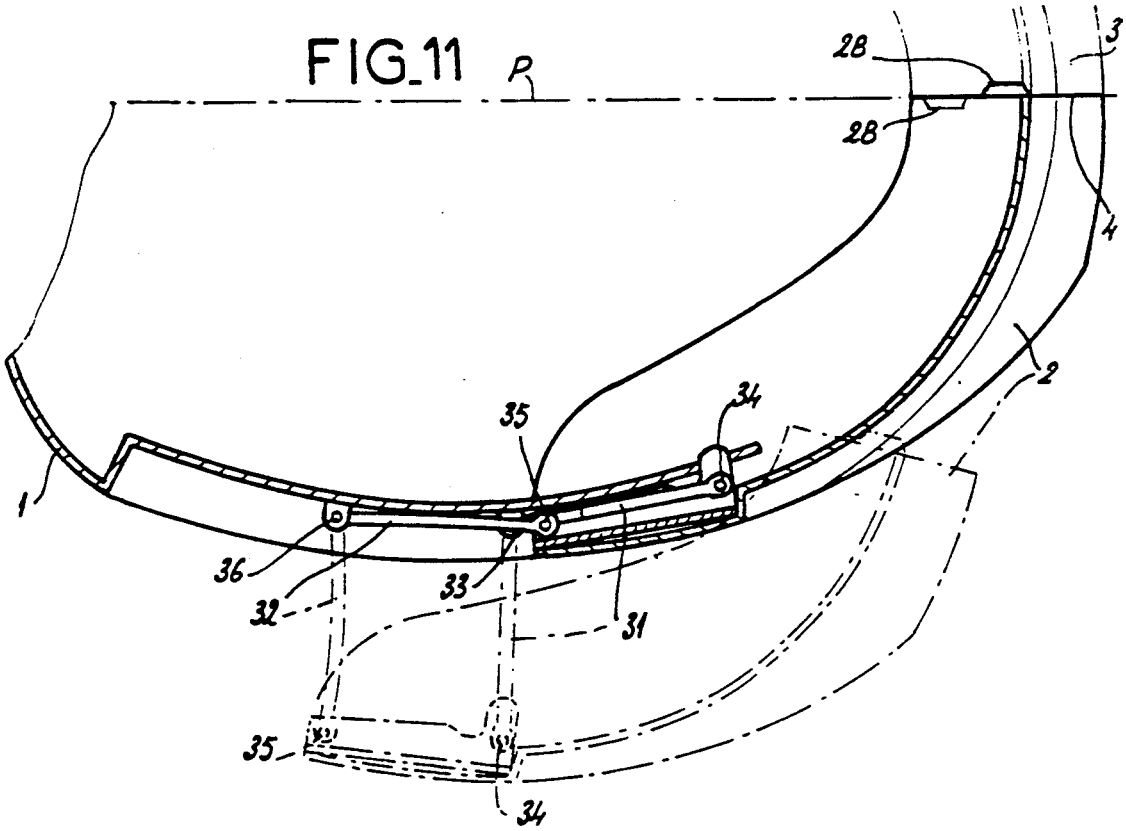
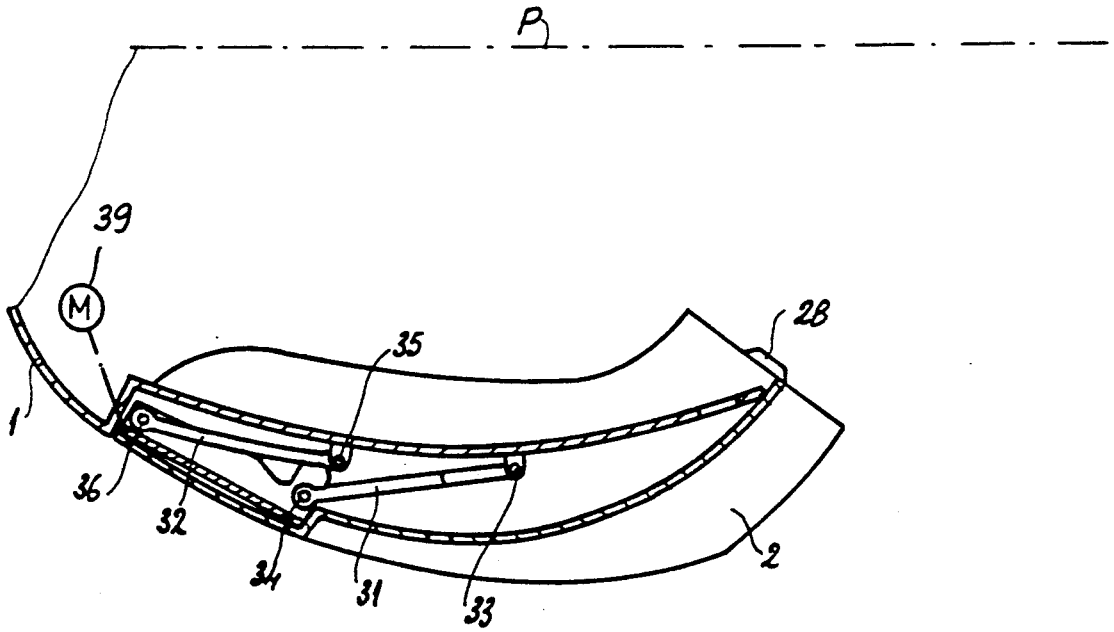
FIG_12

MOTORCYCLE HELMET

FIELD OF THE INVENTION

The present invention relates to a helmet. More particularly this invention concerns a motorcycle helmet.

BACKGROUND OF THE INVENTION

A standard helmet such as worn by a motorcyclist, in particular a police officer, has a rigid head piece that fits over the wearer's head and that is formed with a forwardly open cutout aligned with the wearer's face. For maximum security it is standard in design to form the helmet with a rigid chin guard or protector that bridges the sides of the helmet under the face cutout and that serves to protect the wearer's mouth and jaw region. In addition a transparent lens or visor is provided to cover the face cutout, in particular on a helmet used for security or riot-control work.

In helmets with integral chin guards it is necessary that the chin guard be spaced far enough forward to provide clearance and allow the wearer to doff and don the helmet. Thus such a helmet must also be provided with a separate chin strap that passes under the wearer's jaw and holds the helmet in place. Another disadvantage of the known helmets is that the wearer cannot conveniently talk to someone with it on, as the chin guard blocks his or her mouth, so that the helmet must be taken off when dealing with a person face-to-face.

OBJECTS OF THE INVENTION

It is therefore an object of the present invention to provide an improved helmet.

Another object is the provision of such an improved helmet which overcomes the above-given disadvantages, that is which is easy to take off and put on, which does not need a chin strap, and which does not need to be taken off so the wearer can converse normally with another person.

SUMMARY OF THE INVENTION

A helmet has a rigid head piece adapted to fit over a wearer's head and having a forwardly open cutout aligned with the wearer's face and a chin guard formed by a pair of generally identical right and left arms. Each arm is rigid and has a rear end juxtaposed with the respective side of the head piece and a front end. Mechanisms engaged between each rear end and the respective head-piece side can move the arms between a closed position with their front ends meeting underneath the face cutout and an open position with their front ends spaced apart and flanking the cutout.

With this system the chin guard can itself be a close enough fit to eliminate the need of a chin strap. The helmet is donned with the arms in the open position, and then they are moved into the closed position to engage under the wearer's chin and hold the helmet snugly in place When dealing with the public, the guard can be opened up to expose the wearer's face.

According to the invention each mechanism includes a guide extending horizontally on the respective side of the head piece and a follower slidable along the guide and carried on the respective arm rear end. Each follower includes two vertically spaced rear lugs and horizontally spaced therefrom two vertically spaced front lugs engaging the respective slide. The head piece is formed on each side with a laterally open and forwardly extending recess in which the respective guide is seated and in the closed position of the arms the front lugs disengage from the respective guides to swing the arms inward.

Each arm in accordance with a further invention feature includes a respective inwardly projecting abutment pin and each side of the head piece is formed with a detent hole into which the respective pin engages in the closed position. Removal of the pin makes removal of the respective arm possible in that each pin is formed as a screw threaded into the respective arm and each arm is provided with a flexible cover strip having a front end attached to the respective pin and a rear end extending into the head piece behind the respective mechanism. Each cover strip overlies the respective mechanism in the closed position. Thus if the pin is unscrewed the cover strip can be removed to expose the respective mounting mechanism to allow the guard arm to be taken off. The head piece is formed on each side with a forwardly open slot into which the strips project so that the appearance of the closed helmet is attractive.

It is also within the scope of this invention for each mechanism to include a pair of horizontally spaced links each having one end pivoted on the respective head-piece side and an opposite end pivoted on the respective arm.

Furthermore according to the invention respective latches on the front ends of the arms can lock same together in the closed position. Each latch includes a latch body on the front end of the respective arm provided with a seat and a pin projecting from the latch body and having an outer end provided with a laterally projecting lug. The pin of each latch is engageable in the seat of the other latch body. An actuator can extend the respective pin into the seat of the other latch body and rotate the respective pin for locking the respective lug against the body of the other latch body. The actuator includes a button on the respective latch body shiftable along the body to move the respective pin longitudinally and shiftable transversely on the body to pivot the respective pin. Each button includes one part axially coupled to the respective pin and another part transversely displaceable to pivot it and each latch further includes a spring engaged between the body and the button for retracting the respective pin into the respective body.

Furthermore in accordance with the invention the front ends of the arms are formed with complementary formations that interfit in the closed position and each arm is formed with an upwardly projecting V-shaped bump forming a smooth continuation of the cutout on the respective side. An elastic element urges the arms into the rear position. A remotely controlled motor can displace the arms between their positions.

BRIEF DESCRIPTION OF THE DRAWING

The above and other objects, features, and advantages will become more readily apparent from the following, reference being made to the accompanying drawing in which:

FIGS. 11 and 12 are views like FIGS. 5 and 6, respectively, showing a variant on the instant invention.

SPECIFIC DESCRIPTION

Figure 1:
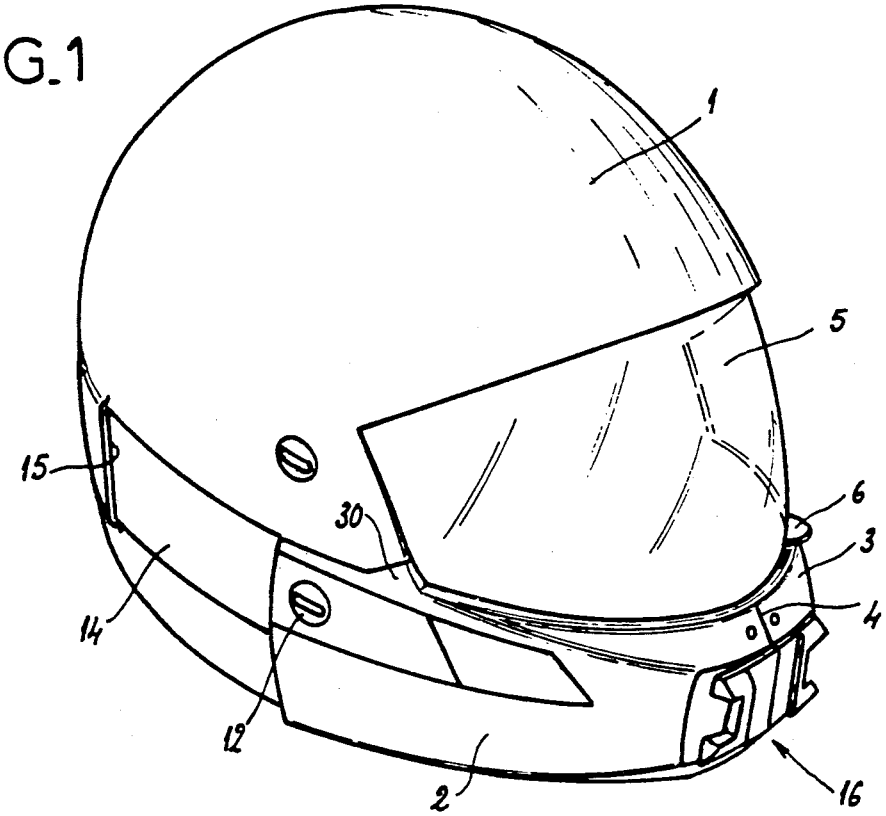
FIG. 1 is a perspective view of the helmet according to the invention with the chin guard closed.
Figure 2:
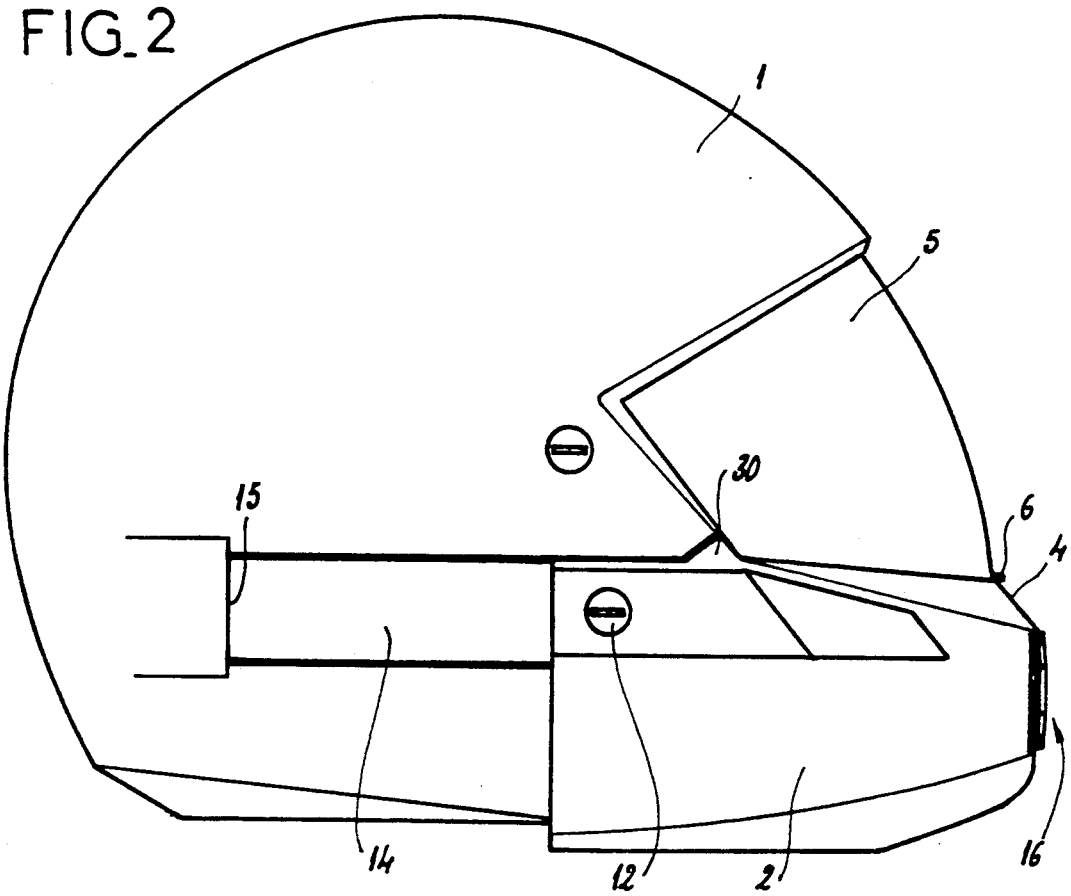
FIG. 2 is a side view of the structure shown in FIG. 1.
Figure 3:
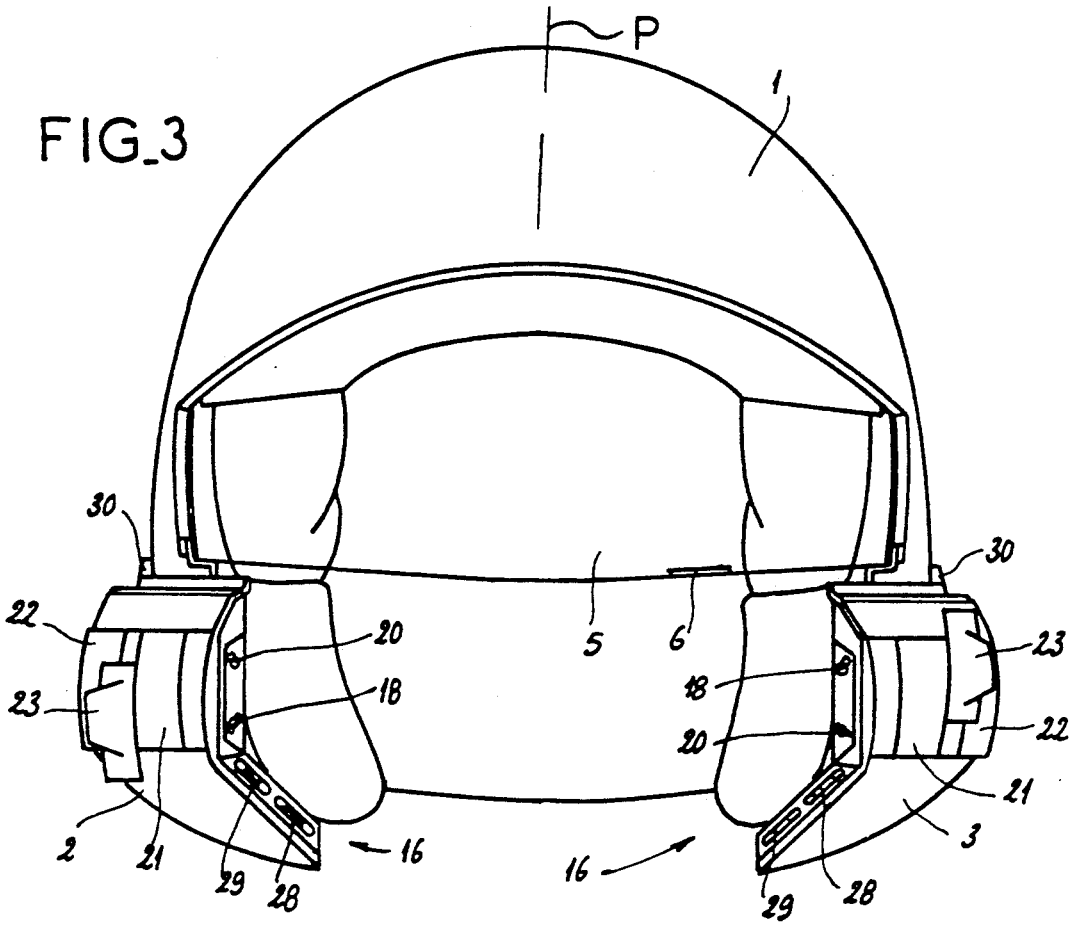
FIG. 3 is a front view of the helmet with the chin guard open.
Figure 7:
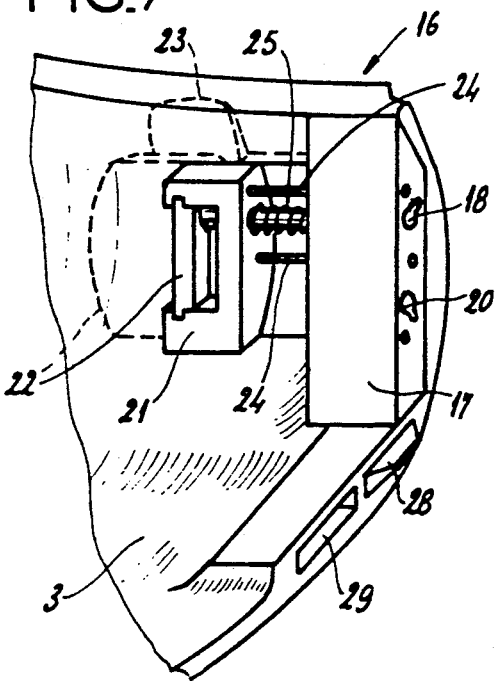
FIGS. 7 and 8 are large-scale perspective views of the latch part of the chin guard in two different positions.
Figure 8:
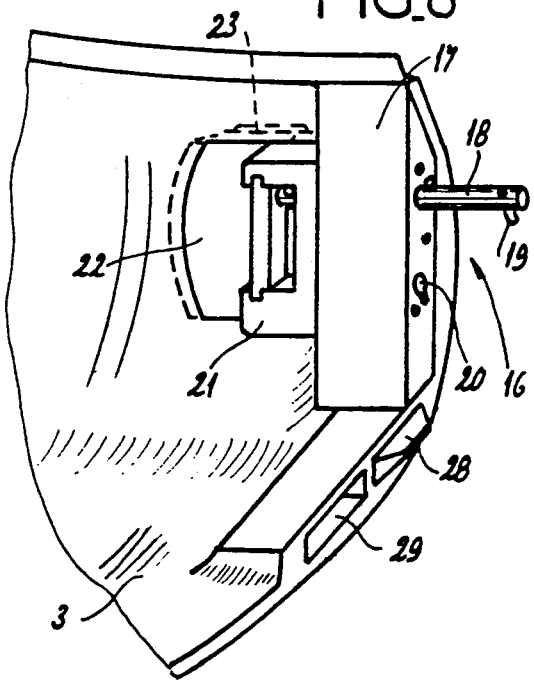

As seen in FIGS. 1 through 3 a helmet according to this invention has a standard ball-shaped head part 1 and a chin guard 2, 3 adapted to engage snugly around the chin of the wearer. The chin guard 2, 3 is formed by a pair of spectrally identical arms 2 and 3 that meet at a joint 4 lying on a sagittal plane P bisecting the helmet from front to back. In addition the helmet has a transparent visor plate 5 with an actuating tab 6 and riding in slots 7 that can be pulled down to cover the face cutout in front of the eye region of the wearer. The two arms 2 and 3 of the chin guard 2, 3 can be moved from a closed position (FIG. 1) joined together at the joint 4 to an open position (FIG. 3). In the closed position the chin guard 2, 3 protects the lower face region of the wearer and, in fact, holds the helmet in place so as to eliminate the need of a chin strap. In the open position the face of the wearer is exposed so he or she can talk or converse normally.

Figure 4:
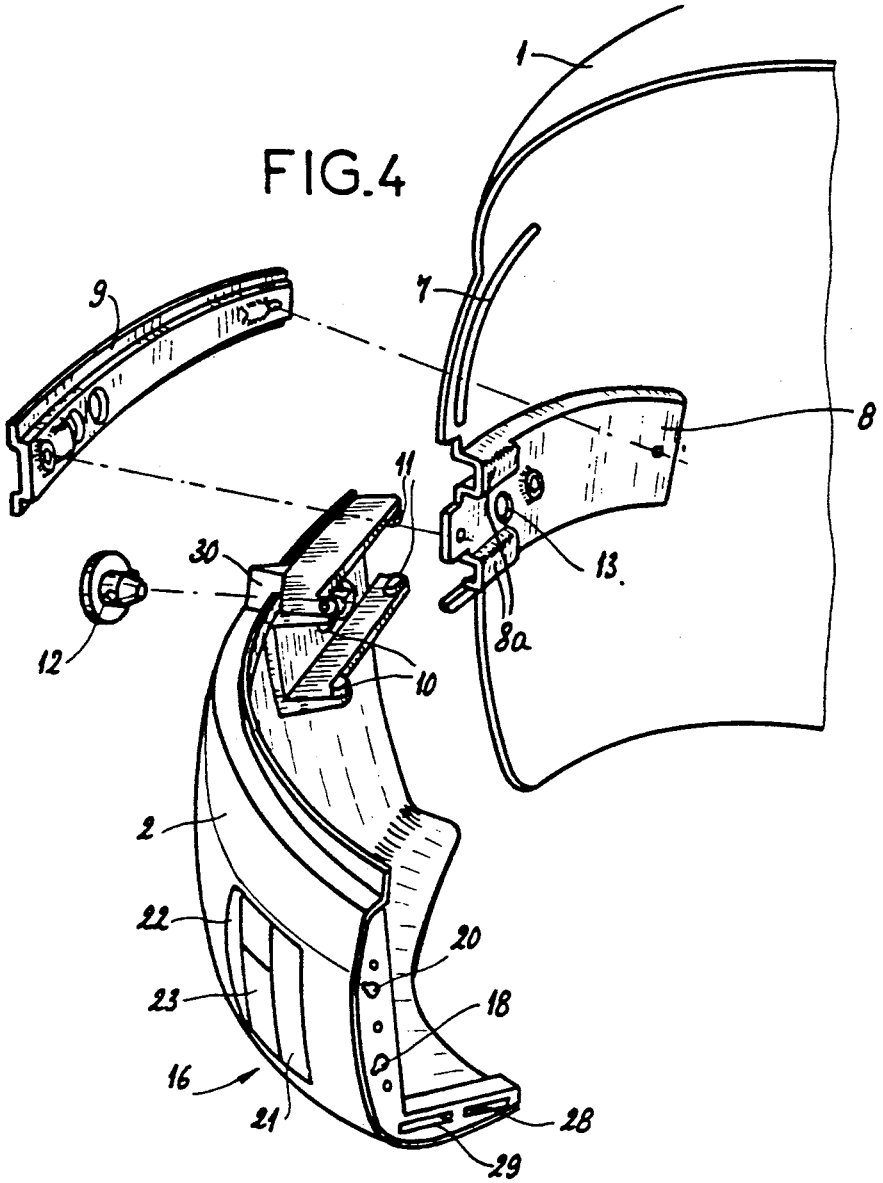
FIG. 4 is a perspective exploded view of a detail of the helmet.
Figure 10:
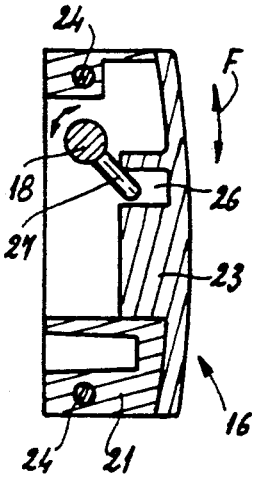
FIG. 10 is a section taken along line X—X of FIG. 9.
Figure 9:
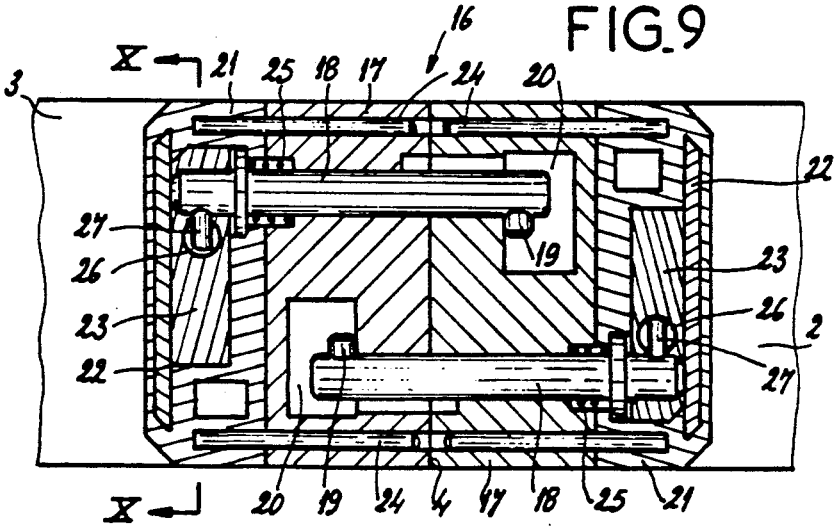
FIG. 9 is a section through the latch when closed.
Figure 5:
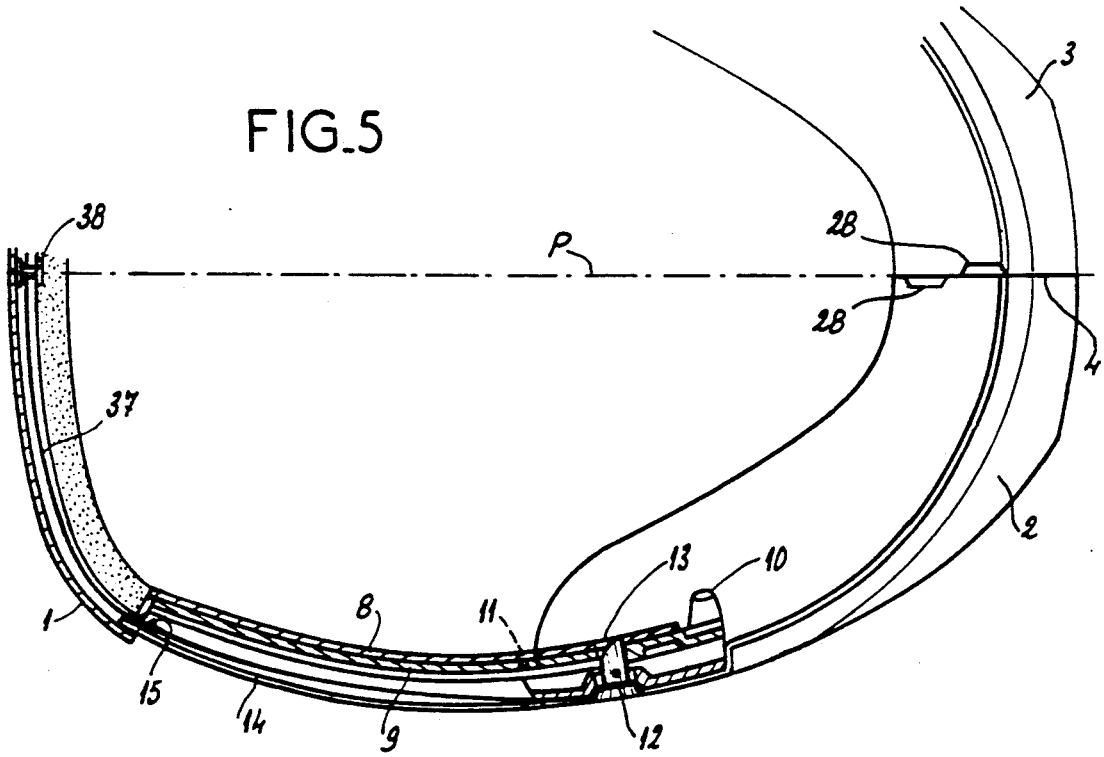
FIGS. 5 and 6 are horizontal sections through details of the helmet with the chin guard in the closed and open positions, respectively.
Figure 6:
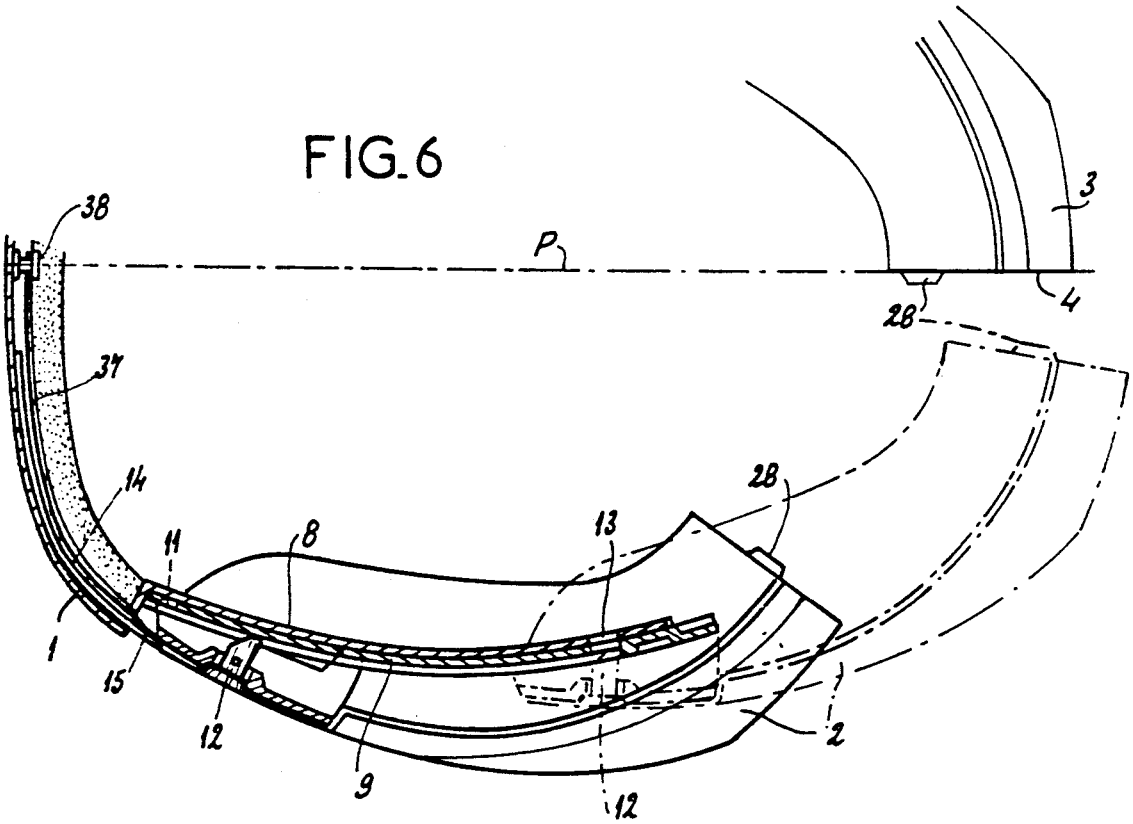

The chin-guard arm 2, shown in more detail in FIGS. 4, 5, and 6, rides in a double rail 9 set in a horizontal and forwardly open recess 8 formed in the side of the helmet. This arm 2 has forward and rear lugs 10 and 11 that ride in the rail, and the guide formed thereby has at its front end deepened portions 8*a* into which the front lugs 10 fit when the guard is closed to swing in the front end of the arm 2. The arm 2 is provided with an abutment screw 12 that fits in the closed position into a hole 13 in the base of the groove 8, and that holds a decorative cover strip 14 that can slide through a slot 15 back into the helmet in the open position of the chin guard 2, 3.

The arms 2 and 3 have as seen in FIGS. 7 through 10 at their front ends latch mechanisms 16 that are substantially identical and that fit together to retain the chin guard 2, 3 in the closed position Each latch 16 comprises a mounting block 17 fixed on the front end of the respective arm 2 or 3 and slidably carrying a locking pin 18 having an outer end formed with a lateral locking lug or dog 19. In addition each block 17 is formed with a keyhole-section hole 20 into which the pin 18 of the other latch 16 can fit.

The rear end of each pin 18 is pivoted in a slide button comprising three parts 21, 22, and 23. The part 21 is mounted via pins 24 on the block 17 and can slide relative thereto parallel to the pin 18, with a spring 25 braced between the block 17 and part 21 to push the latter back. The part 22 is fixed to the part 21 and flanks with the part 21 a middle button 23 which can move vertically as indicated by arrow F relative to the parts 21 and 22. This part 23 has a hole 26 into which a radially projecting pin 27 from the respective rod 18 can fit so that vertical movement of the part 23 will rotate the respective pin 18 about its axis.

Thus when the two arms 2 and 3 are pushed together to meet at the joint 4, the buttons 21–23 are pushed together to engage each pin 18 into the hole 20 of the other latch 16. Then the two buttons 23 are moved oppositely vertically until they are horizontally in line, which action causes the respective pins 18 to rotate and engage with their lugs 19 behind the blocks 17 of the other latches 16, thereby solidly locking the arms 2 and 3 together. In this position a pyramidal bump 28 on each arm 2 or 3 engages in a complementary recess 29 on the other arm 3 or 2 to further hold the chin guard 2, 3 together.

To open the chin guard 2, 3, the buttons 23 are simply moved oppositely and then released, so that the springs 25 will snap the pins 18 out of the holes 19. Then the arms 2 and 3 are swung back to the FIG. 3 position. The opposite movement of the buttons 23 needed to open the chin guard 2, 3 prevents it from being opened accidentally, for instance in an accident where it strikes or slides against something. In addition each hole 20 is formed with a slightly helical ramp against which the respective lug 10 engages to ensure that the latches 16 actually clamp the two arms 2 and 3 together at the joint 4.

Each arm 2 and 3 is formed with a triangular upward extension that forms a smooth continuation of the face cutout of the helmet that can be blocked by the lens 5 as seen in FIG. 1. In addition as seen in FIGS. 5 and 6 an elastic return element 37, here an elastic strand or spring, has ends hooked to the rear ends of the arms 2 and 3 and a center secured at 38 to the rear center of the helmet. This element 37 extends out through the slots 15 under the cover strips 14 and serves to pull back the arms 2 and 3 so that when the latches 16 are undone these arms 2 and 3 automatically move back to the open position of FIG. 3.

The seams between the arms 2 and 3 and the head piece 1 are provided with unillustrated seals as are the joints around the lens 5. Thus the helmet can be sealed tightly against water.

FIGS. 11 and 12 show a double-arm linkage replacing the slide linkage of FIGS. 1 through 10. Here a front link and a back link 31 and 32 have front ends pivoted at 33 and 35, respectively, on the head part 1, and back ends pivoted at 34 and 36 on the arm 2, which of course is substantially identical to the arm 3. Thus the arms 2 and 3 can be swung from the forward locked position shown in solid lines in FIG. 11 through the intermediate position shown in dot-dash lines in FIG. 11 to the rear open position shown in FIG. 12.

It is possible to provide such a helmet with a mechanism to automatically push up the visor 5, which frequently is tinted, when the chin guard 2, 3 is opened. In addition tiny motors such as shown at 39 in FIG. 12 can effect the opening, and can in fact be operated by remote control if desired.

We claim:

1. A helmet comprising:

a rigid head piece shaped to fit over a wearer's head and having right and left sides and a forwardly open cutout therebetween aligned with the wearer's face;

a chin guard formed by a pair of generally identical right and left arms, each arm being rigid and having a rear end juxtaposed with the respective side of the head piece and a front end; and mounting means including respective mechanisms engaged between each rear end and the respective head-piece side for movement of the arms between a closed position with their front ends meeting underneath the face cutout and an open position with their front ends spaced apart and flanking the cutout and lying laterally adjacent the respective sides of the head piece rearward of the cutout.

2. The helmet defined in claim 1 wherein each arm includes a respective inwardly projecting abutment pin, each side of the head piece being formed with a detent hole into which the respective pin engages in the closed position.

3. The helmet defined in claim 2 wherein removal of the pin makes removal of the respective arm possible.

4. The helmet defined in claim 2 wherein each pin is formed as a screw threaded into the respective arm.

5. The helmet defined in claim 4 wherein each arm is provided with a flexible cover strip having a front end attached to the respective pin and a rear end extending into the head piece behind the respective mechanism, each cover strip overlying the respective mechanism in the closed position.

6. The helmet defined in claim 5 wherein the head piece is formed on each side with a forwardly open slot into which the strips project.

7. The helmet defined in claim 1 wherein each mechanism includes a pair of horizontally spaced links each having one end pivoted on the respective head-piece side and an opposite end pivoted on the respective arm.

8. The helmet defined in claim 1, further comprising means including respective latches on the front ends of the arms for locking them together in the closed position.

9. The helmet defined in claim 8 wherein each latch includes a latch body on the front end of the respective arm and provided with a seat, a pin projecting from the latch body and having an outer end provided with a laterally projecting lug, the pin of each latch being engageable in the seat of the other latch body, and actuating means for extending each pin into the seat of the other latch body and rotating the pin for locking the respective lug against the body of the other latch body.

10. The helmet defined in claim 9 wherein the actuating means includes a button on the respective latch body shiftable along the body to move the respective pin longitudinally and shiftable transversely on the body to pivot the respective pin.

11. The helmet defined in claim 10 wherein each button includes one part axially coupled to the respective pin and another part transversely displaceable to pivot it, each latch further including a spring engaged between the body and the button for retracting the respective pin into the respective body.

12. The helmet defined in claim 1 wherein the front ends of the arms are formed with complementary formations that interfit in the closed position.

13. The helmet defined in claim 1 wherein each arm is formed with an upwardly projecting triangular bump forming a smooth continuation of the cutout on the respective side.

14. The helmet defined in claim 1, further comprising elastic means for urging the arms into the rear position.

15. The helmet defined in claim 1, further comprising at least one motor for displacing the arms between their positions.

16. A helmet comprising:

a rigid head piece shaped to fit over a wearer's head and having right and left sides and a forwardly open cutout therebetween aligned with the wearer's face;

a chin guard formed by a pair of generally identical right and left arms, each arm being rigid and having a rear end juxtaposed with the respective side of the head piece and a front end;

mounting means including respective guides extending horizontally on the respective side of the head piece and respective followers slidable along the guides and carried on the respective arm rear ends, the guides and followers being engaged between each arm rear end and the respective head-piece side for movement of the arms between a closed position with their front ends meeting underneath the face cutout and an open position with their front ends spaced apart and flanking the cutout; and means including respective latches on the front ends for securing the right and left arms together in the closed position.

17. The helmet defined in claim 16, wherein each follower includes two vertically spaced rear lugs and horizontally spaced therefrom two vertically spaced front lugs engaging the respective guide.

18. The helmet defined in claim 17 wherein the head piece is formed on each side with a laterally open and forwardly extending recess in which the respective guide is seated.

19. The helmet defined in claim 17 wherein the closed position of the arms the front lugs are disengaged from the respective guides.

20. A helmet comprising:

a rigid head piece shaped to fit over a wearer's head and having right and left sides and a forwardly open cutout therebetween aligned with the wearer's face;

a chin guard formed by a pair of generally identical right and left arms, each arm being rigid and having a rear end juxtaposed with the respective side of the head piece and a front end; and mounting means including respective mechanism engaged between each rear end and the respective head-piece side for movement of the arms between a closed position with their front ends meeting underneath the face cutout and defining a lower edge of the cutout and an open position with their front ends spaced apart, flanking the cutout, and completely downwardly opening the cutout, whereby in the open position the wearer's face and chin is substantially completely exposed in the cutout.

* * * * *